US010341754B2

(12) United States Patent
Cui et al.

(10) Patent No.: US 10,341,754 B2
(45) Date of Patent: Jul. 2, 2019

(54) MICROPHONE BOOM STRUCTURE

(71) Applicant: QINGDAO GOERTEK TECHNOLOGY CO., LTD., Qingdao (CN)

(72) Inventors: Zengsen Cui, Qingdao (CN); Long Yuan, Qingdao (CN); Fujian Wang, Qingdao (CN)

(73) Assignee: Qingdao Goertek Technology Co., Ltd., Qingdao, Shandong Province (CN)

( * ) Notice: Subject to any disclaimer, the term of this patent is extended or adjusted under 35 U.S.C. 154(b) by 0 days.

(21) Appl. No.: 16/073,489

(22) PCT Filed: Dec. 31, 2016

(86) PCT No.: PCT/CN2016/114040
§ 371 (c)(1),
(2) Date: Jul. 27, 2018

(87) PCT Pub. No.: WO2017/197898
PCT Pub. Date: Nov. 23, 2017

(65) Prior Publication Data

US 2019/0045289 A1 Feb. 7, 2019

(30) Foreign Application Priority Data

May 14, 2016 (CN) ..... 2016 1 0322997

(51) Int. Cl.
*H04R 1/00* (2006.01)
*H04R 1/08* (2006.01)
(Continued)

(52) U.S. Cl.
CPC ..... *H04R 1/083* (2013.01); *H04R 1/04* (2013.01); *H04R 1/08* (2013.01); *H04R 31/00* (2013.01); *H04R 2201/025* (2013.01)

(58) Field of Classification Search
CPC . H04R 1/08; H04R 1/083; H04R 1/10; H04R 1/105; H04M 1/05
See application file for complete search history.

(56) References Cited

U.S. PATENT DOCUMENTS 1,827,432 A * 10/1931 Hundemer ..... F16L 11/18 138/120
3,584,822 A * 6/1971 Oram ..... F16M 11/40 248/160
(Continued)

FOREIGN PATENT DOCUMENTS

CN 2733962 Y 10/2005
CN 201667045 U 12/2010
(Continued)

OTHER PUBLICATIONS

First Office Action and Type of Search dated Apr. 18, 2018, for Application No. 201610322997.1.
(Continued)

*Primary Examiner* — Matthew A Eason
(74) *Attorney, Agent, or Firm* — Buchanan Ingersoll & Rooney PC

(57) ABSTRACT

A microphone boom structure includes a first and second end boom segments, and intermediate boom segments sequentially disposed between the first end boom segment and the second end boom segment. An end of the first end boom segment is hinged with an end of the adjacent intermediate boom segment, an end of the second end boom segment is hinged with an end of the adjacent intermediate boom segment, and the ends of two adjacent intermediate boom segments are hinged. An adjusting structure is provided between the first end boom segment and the adjacent intermediate boom segment, between the second end boom segment and the adjacent intermediate boom segment, and between the two adjacent intermediate boom segments. The
(Continued)

adjusting structure includes an axial hole formed in a boom segment, an adjusting bar inserted into the axial hole, and an elastic compression member disposed between the axial hole and the adjusting bar.

20 Claims, 3 Drawing Sheets

(51) Int. Cl.
*H04R 1/04* (2006.01)
*H04R 31/00* (2006.01)

(56) References Cited

U.S. PATENT DOCUMENTS 3,986,692 A * 10/1976 Kinoshita ..... F16C 11/106 248/160
4,748,671 A * 5/1988 Wiegel ..... H04M 1/05 16/257
5,348,259 A * 9/1994 Blanco ..... A61B 17/115 227/19
RE38,897 E * 11/2005 Krenzel ..... F16M 11/40 362/191
10,130,809 B2 * 11/2018 Cartledge ..... A61N 1/05
2003/0026446 A1 * 2/2003 Davis ..... F16C 11/10 381/390
2003/0076976 A1 * 4/2003 Fukuda ..... H04R 1/08 381/362
2005/0259811 A1 * 11/2005 Kimm ..... H04M 1/05 379/430
2009/0264073 A1 10/2009 Kushnirov
2011/0031359 A1 * 2/2011 Lu ..... F16M 11/40 248/187.1
2014/0234015 A1 * 8/2014 Kallas ..... H04R 1/083 403/90
2016/0134957 A1 * 5/2016 Jentz ..... H04R 1/105 381/380

FOREIGN PATENT DOCUMENTS

CN 201674642 U 12/2010
CN 202652497 U 1/2013
CN 203039861 U 7/2013
CN 203675279 U 6/2014
CN 203851268 U 9/2014
CN 204192566 U 3/2015
CN 105792053 A 7/2016
CN 205793149 U 12/2016
DE 7929287 5/1980
DE 202010008989 U1 3/2011

OTHER PUBLICATIONS

Written Opinion (PCT/ISA/237) dated Apr. 12, 2017, by the Chinese Patent Office as the International Searching Authority for International Application No. PCT/CN2016/114040.
International Search Report (PCT/ISA/210) dated Apr. 12, 2017, by the Chinese Patent Office as the International Searching Authority for International Application No. PCT/CN2016/114040.
European Search Report issued in corresponding European Patent Application No. 1602277.9-1210/3396974, dated Feb. 18, 2019, with English Translation (4 pages).

* cited by examiner

MICROPHONE BOOM STRUCTURE

CROSS REFERENCE TO RELATED APPLICATIONS

This application is a U.S. National Stage entry under 35 U.S.C. § 371 based on International Application No. PCT/CN2016/114040, filed on Dec. 31, 2016, which was published under PCT Article 21(2) and which claims priority to Chinese Patent Application No. 201610322997.1, filed on May 14, 2016. The entire contents of each of which are incorporated herein by reference.

TECHNICAL FIELD

The present disclosure pertains to the technical field of electroacoustic products, and more specifically to a microphone boom structure.

BACKGROUND

Headphones are commonly used in work, games, and daily life. The existing microphone booms of headphones cannot be bent or folded, and the distance between the microphone on the microphone boom and the user cannot be adjusted to fit different consumer groups, so they are inconvenient to use.

SUMMARY

An object of the present disclosure is to provide a bendable and foldable microphone boom structure to solve the problem that the distance between the microphone on the microphone boom and the user is unadjustable.

To achieve the above object, the technical solutions of the present disclosure are as follows.

A microphone boom structure, comprising a first end boom segment, a second end boom segment, and a plurality of intermediate boom segments sequentially disposed between the first end boom segment and the second end boom segment;

an end of the first end boom segment is hinged with an end of the adjacent intermediate boom segment, an end of the second end boom segment is hinged with an end of the adjacent intermediate boom segment, and the ends of two adjacent intermediate boom segments are hinged;

an adjusting structure is further provided between the end of the first end boom segment and the end of the adjacent intermediate boom segment, the end of the second end boom segment and the end of the adjacent intermediate boom segment, and the ends of two adjacent intermediate boom segments, respectively; and the adjusting structure comprises an axial hole provided in a boom segment, an adjusting bar inserted into the axial hole, and an elastic compression member disposed between the axial hole and the adjusting bar.

In some embodiments, the axial hole is provided in the first end boom segment, and the axial hole extends from the end of the first end boom segment that is closer to the intermediate boom segment to the other end thereof; and the axial hole in the intermediate boom segment extends from the end of the intermediate boom segment that is further away from the first end boom segment to the other end thereof.

or, the axial hole is provided in the second end boom segment, and the axial hole extends from the end of the second end boom segment that is closer to the intermediate boom segment to other end thereof and the axial hole in the intermediate boom segment extends from the end of the intermediate boom segment that is further away from the second end boom segment to the other end thereof.

In some embodiments an end of the adjusting bar that is further away from the elastic compression member is convexly curved, and an arc-shaped concave cavity is arranged at a position of the end of the intermediate boom segment that is corresponding to the adjusting bar.

In some embodiments, the adjusting bar has a shape of a hollow tube.

In some embodiments, connecting lugs are separately provided at the ends of the first end boom segment and the second end boom segment that are closer to the intermediate boom segment, and both ends of the intermediate boom segments, respectively;

the connecting lugs are disposed on opposite sides of the axial hole; and a hinge shaft is connected between two adjacent connecting lugs of the first end boom segment and the adjacent intermediate boom segment, between two adjacent connecting lugs of the second end boom segment and the adjacent intermediate boom segment, and between two adjacent connecting lugs of two adjacent intermediate boom segments, respectively.

In some embodiments, the hinge shaft is a cylindrical pin whose diameter is less than a diameter of a through hole in one of the connecting lugs and greater than a diameter of a through hole in the other connecting lug.

In some embodiments, a diameter of a through hole located in the connecting lug at an outer side is less than a diameter of a through hole located in the connecting lug at an inner side.

In some embodiments, the hinge shaft is a T-shaped pin whose diameter is less than a diameter of a through hole in one of the connecting lugs and greater than a diameter of a through hole in the other connecting lug; and an accommodating cavity for accommodating a larger end of the pin is further provided between the connecting lug and an outer side of the boom segment.

In some embodiments, the axial hole in the intermediate boom segment is a stepped through hole, and the elastic compression member and the adjusting bar are both arranged in the larger hole part of the stepped through hole.

In some embodiments, the elastic compression member is a spring.

Since an axial hole is provided in a boom segment, an adjusting bar is provided in the axial hole and an elastic compression member is arranged between the axial hole and the adjusting bar, the end of the adjusting bar presses against the end of the adjacent boom segment under the action of the elastic force of the elastic compression member. In this way, two adjacent boom segments are positioned and fixed so as to achieve the bending of the entire microphone boom structure and a certain shape formed by fixed connection. When the microphone boom structure is used, the distance between the microphone on the microphone boom and the user can be adjusted as required. When it is not used, the microphone boom structure can be bent and folded into a certain shape. The microphone boom structure according to the present embodiment can be bent and folded so as to solve the problem that the distance between the microphone on the microphone boom and the user is unadjustable.

BRIEF DESCRIPTION OF DRAWINGS

The present disclosure will hereinafter be described in conjunction with the following drawing figures, wherein like numerals denote like elements, and.

Figure 1:
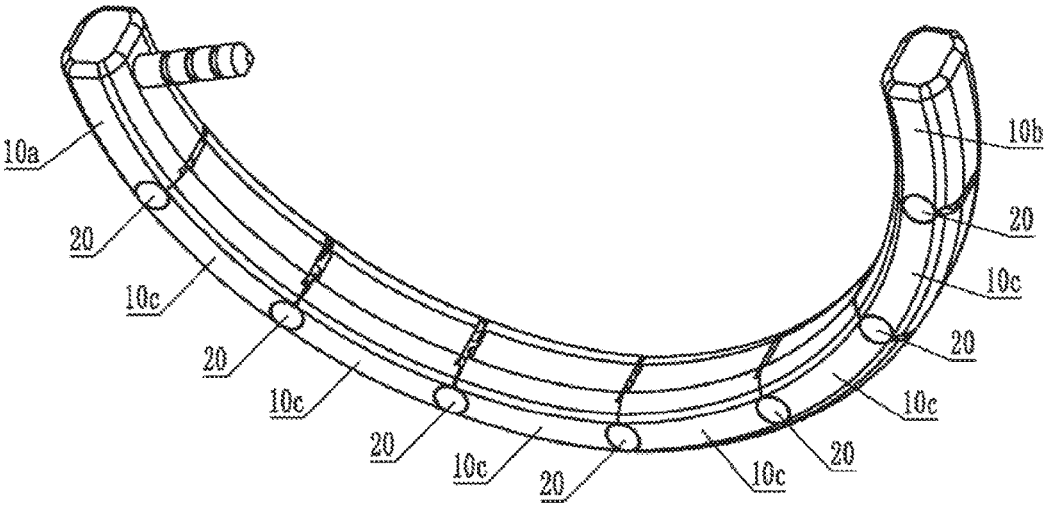
FIG. 1 is a schematic diagram of a bent state of a microphone boom structure according to an embodiment of the present disclosure.

In the drawings, 10*a*: end boom segment, 10*b*: end boom segment, 10*c*: intermediate boom segment, 11: axial hole, 12: connecting lug, 20: hinge shaft, 30: adjusting bar, 40: spring.

DETAILED DESCRIPTION

In order to make the objectives, technical solutions and advantages of the present disclosure clearer, the present disclosure is further described in detail with reference to the accompanying drawings and the embodiments. It should be understood that the specific embodiments described herein are only used to explain the present disclosure and are not intended to limit the present disclosure.

Figure 2:
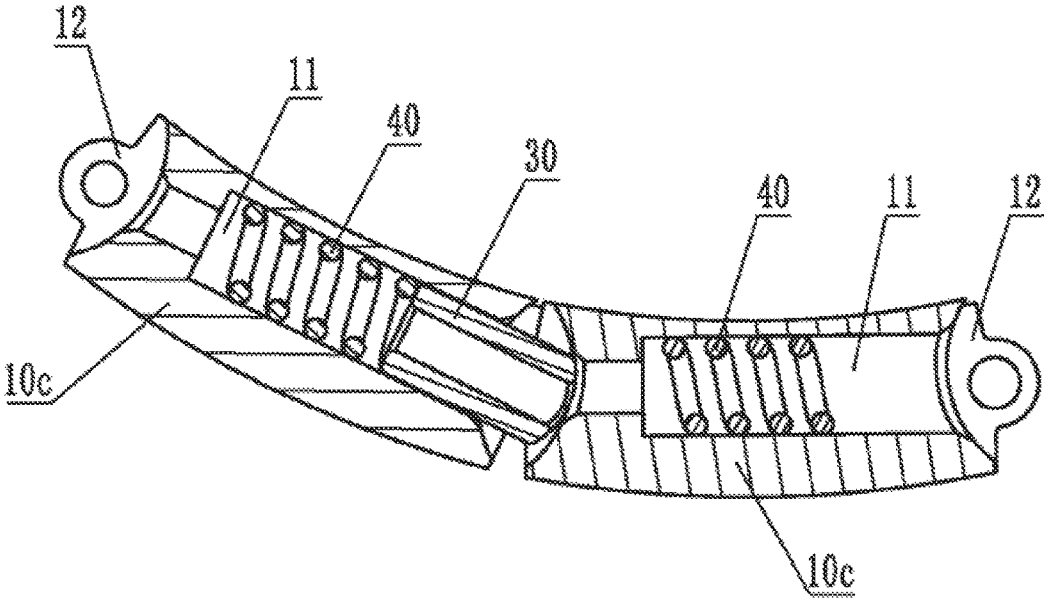
FIG. 2 is a schematic partial cross section view of a bent state of a microphone boom structure according to an embodiment of the present disclosure.
Figure 3:
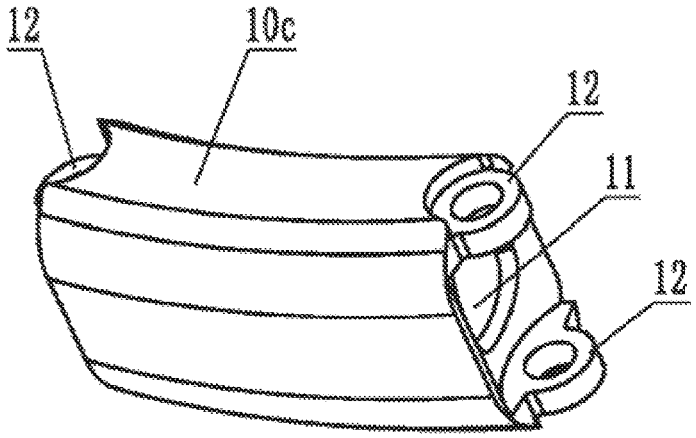
FIG. 3 is a schematic view of an intermediate boom segment of a microphone boom structure according to an embodiment of the present disclosure.
Figure 4:
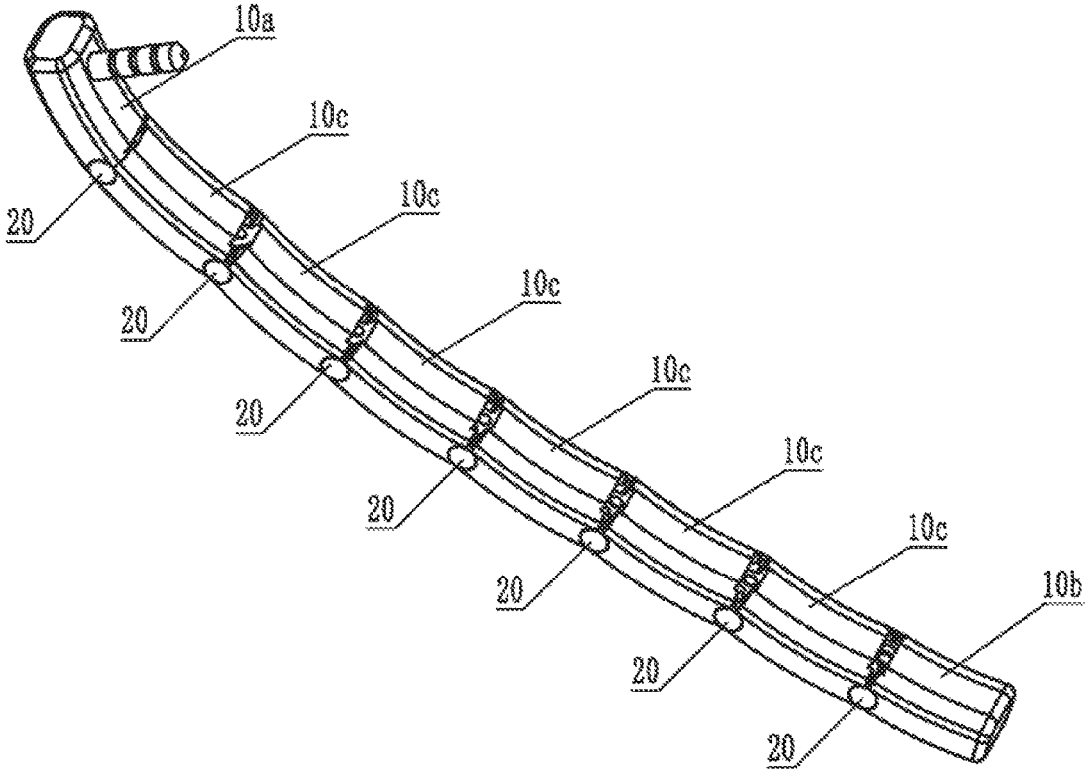
FIG. 4 is a schematic diagram of a straightened state of a microphone boom structure according to an embodiment of the present disclosure.
Figure 5:
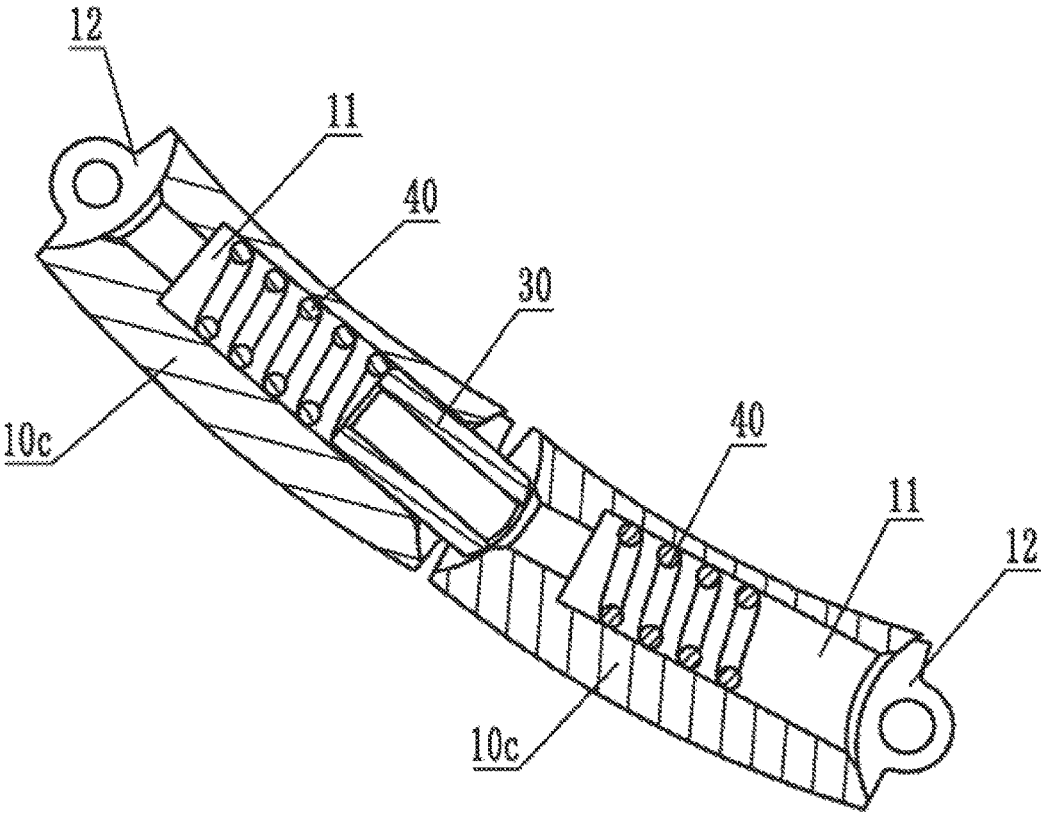
FIG. 5 is a schematic partial cross section view of a straightened state of a microphone boom structure according to an embodiment of the present disclosure.
Figure 6:
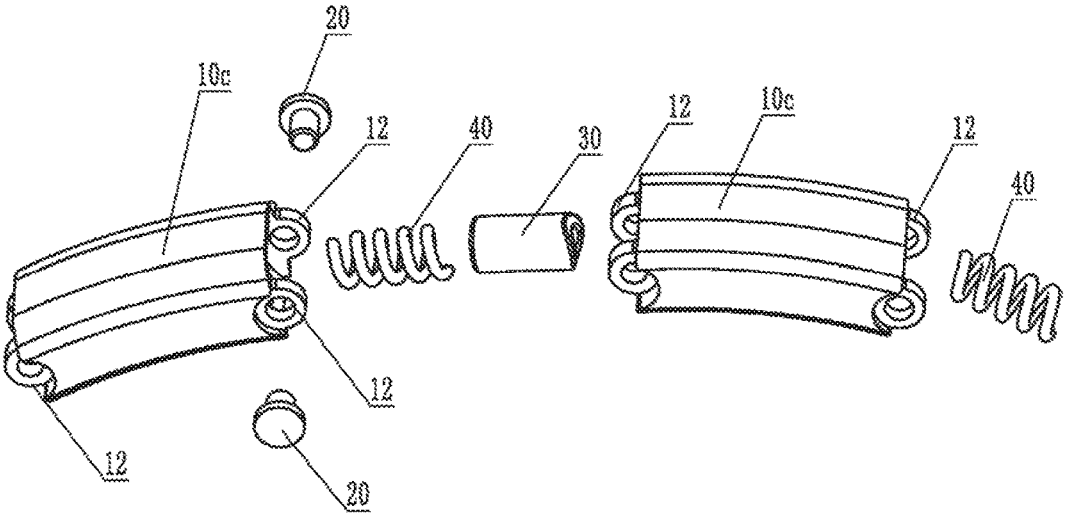
FIG. 6 is a schematic exploded view of adjacent intermediate boom segments of a microphone boom structure according to an embodiment of the present disclosure.

As can be seen from FIG. 1 to FIG. 6, the microphone boom structure comprises a first end boom segment 10*a*, a second end boom segment 10*b*, and several intermediate boom segments 10*c* sequentially disposed between the first end boom segment 10*a* and the second end boom segment 10*b*. An end of the first end boom segment 10*a* is hinged with an end of the adjacent intermediate boom segment 10*c*, an end of the second end boom segment 10*b* is hinged with an end of the adjacent intermediate boom segment 10*c*, and the ends of two adjacent intermediate boom segments 10*c* are hinged. An adjusting structure is further provided between the end of the first end boom segment 10*a* and the end of the adjacent intermediate boom segment 10*c*, the end of the second end boom segment 10*b* and the end of the adjacent intermediate boom segment 10*c*, and the ends of two adjacent intermediate boom segments 10*c*, respectively. The adjusting structure comprises an axial hole 11 provided in a boom segment, an adjusting bar 30 inserted into the axial hole 11, and an elastic compression member disposed between the axial hole 11 and the adjusting bar 30. In the present embodiment, the elastic compression member is a spring 40, although other elastic members such as rubber posts may be selected.

During installation, a plug is arranged on the first end boom segment 10*a*, and the plug is inserted into the headphones to achieve the connection between the microphone boom and the headphones. Since an axial hole 11 is provided in a boom segment, an adjusting bar 30 is provided in the axial hole 11, and an elastic compression member is arranged between the axial hole 11 and the adjusting bar 30, the end of the adjusting bar 30 presses against the end of the adjacent boom segment under the action of the elastic force of the elastic compression member. In this way, two adjacent boom segments are positioned and fixed so as to achieve the bending of the entire microphone boom structure and a certain shape formed by fixed connection. When the microphone boom structure is used, the distance between the microphone on the microphone boom and the user can be adjusted as required. When it is not used, the microphone boom structure can be bent and folded into a certain shape. The microphone boom structure according to the present embodiment can be bent and folded so as to solve the problem that the distance between the microphone on the microphone boom and the user is unadjustable.

In the present embodiment, an axial hole 11 is provided in the first end boom segment 10*a*, and the axial hole 11 extends from the end of the first end boom segment 10*a* that is closer to the intermediate boom segment 10*c* to the other end thereof. The axial hole 11 in the intermediate boom segment 10*c* extends from the end of the intermediate boom segment 10*c* that is further away from the first end boom segment 10*a* to the other end thereof.

Of course, an axial hole 11 may also be provided in the second end boom segment 10*b*, and the axial hole 11 extends from the end of the second end boom segment 10*b* that is closer to the intermediate boom segment 10*c* to other end thereof. The axial hole 11 in the intermediate boom segment 10*c* extends from the end of the intermediate boom segment 10*c* that is further away from the second end boom segment 10*b* to the other end thereof.

The end of the adjusting bar 30 that is further away from the elastic compression member is convexly curved, and an arc-shaped concave cavity is arranged at a position of the end of the intermediate boom segment 10*c* that is corresponding to the adjusting bar 30, to facilitate the positioning and fixing between two adjacent boom segments. Of course, the end of the adjusting bar 30 that is further away from the elastic compression member may also be concavely curved, and the corresponding end of the intermediate boom segment 10*c* is convexly curved to adapt to the shape of the end of the adjusting bar 30.

In the present embodiment, connecting lugs 12 are separately provided at the ends of the first end boom segment 10*a* and the second end boom segment 10*b* which are closer to the intermediate boom segment 10*c*, and both ends of the intermediate boom segments 10*c*, respectively. The connecting lugs 12 are disposed at opposite sides of the axial hole 11. A hinge shaft 20 is connected between two adjacent connecting lugs 12 of the first end boom segment 10*a* and the adjacent intermediate boom segment 10*c*, between two adjacent connecting lugs 12 of the second end boom segment 10*b* and the adjacent intermediate boom segment 10*c*, and between two adjacent connecting lugs 12 of two adjacent intermediate boom segments 10*c*, respectively. The hinge shaft 20 is a cylindrical pin whose diameter is less than the diameter of the through hole in one connecting lug 12 and greater than the diameter of the through hole in the other connecting lug 12.

Specifically, the diameter of the through hole located in the connecting lug 12 at an outer side is greater than the diameter of the through hole located in the connecting lug 12 at an inner side, which can improve the appearance of the microphone boom structure.

Of course, the hinge shaft 20 may be a T-shaped pin whose diameter is less than the diameter of the through hole in one connecting lug 12 and greater than the diameter of the through hole in the other connecting lug 12. An accommodating cavity for accommodating the larger end of the pin is provided between the connecting lug 12 and the outer side of the boom segment, so as to prevent the pin from being exposed outside the outer side of the boom segment and affecting its appearance.

In the present embodiment, the axial hole 11 in the intermediate boom segment 10*c* is a stepped through hole, and the elastic compression member and the adjusting bar 30 are both arranged in the larger hole part of the stepped through hole, to make the wire running in the axial hole 11 easy and facilitate installation.

In the present embodiment, the adjusting bar 30 has the shape of a hollow tube, which can reduce the material being used as well as its weight.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A microphone boom structure, comprising a first end boom segment, a second end boom segment, and a plurality of intermediate boom segments sequentially disposed between the first end boom segment and the second end boom segment;

an end of the first end boom segment is hinged with an end of the adjacent intermediate boom segment, an end of the second end boom segment is hinged with an end of the adjacent intermediate boom segment, and the ends of two adjacent intermediate boom segments are hinged;

an adjusting structure is further provided between the end of the first end boom segment and the end of the adjacent intermediate boom segment, the end of the second end boom segment and the end of the adjacent intermediate boom segment, and the ends of two adjacent intermediate boom segments, respectively; and the adjusting structure comprises an axial hole provided in a boom segment, an adjusting bar inserted into the axial hole, and an elastic compression member disposed between the axial hole and the adjusting bar.

2. The microphone boom structure according to claim 1, wherein the axial hole is provided in the first end boom segment, and the axial hole extends from the end of the first end boom segment that is closer to the intermediate boom segment to the other end thereof; and the axial hole in the intermediate boom segment extends from the end of the intermediate boom segment that is further away from the first end boom segment to the other end thereof the axial hole is provided in the second end boom segment, and the axial hole extends from the end of the second end boom segment that is closer to the intermediate boom segment to other end thereof; and the axial hole in the intermediate boom segment extends from the end of the intermediate boom segment that is further away from the second end boom segment to the other end thereof.

3. The microphone boom structure according to claim 2, wherein an end of the adjusting bar that is further away from the elastic compression member is convexly curved, and an arc-shaped concave cavity is arranged at a position of the end of the intermediate boom segment that is corresponding to the adjusting bar.

4. The microphone boom structure according to claim 3, wherein the adjusting bar has a shape of a hollow tube.

5. The microphone boom structure according to claim 1, wherein connecting lugs are separately provided at the ends of the first end boom segment and the second end boom segment that are closer to the intermediate boom segment, and both ends of the intermediate boom segments, respectively;

the connecting lugs are disposed on opposite sides of the axial hole; and a hinge shaft is connected between two adjacent connecting lugs of the first end boom segment and the adjacent intermediate boom segment, between two adjacent connecting lugs of the second end boom segment and the adjacent intermediate boom segment, and between two adjacent connecting lugs of two adjacent intermediate boom segments, respectively.

6. The microphone boom structure according to claim 5, wherein the hinge shaft is a cylindrical pin whose diameter is less than a diameter of a through hole in one of the connecting lugs and greater than a diameter of a through hole in the other connecting lug.

7. The microphone boom structure according to claim 6, wherein a diameter of a through hole located in the connecting lug at an outer side is less than a diameter of a through hole located in the connecting lug at an inner side.

8. The microphone boom structure according to claim 5, wherein the hinge shaft is a T-shaped pin whose diameter is less than a diameter of a through hole in one of the connecting lugs and greater than a diameter of a through hole in the other connecting lug; and an accommodating cavity for accommodating a larger end of the pin is further provided between the connecting lug and an outer side of the boom segment.

9. The microphone boom structure according to claim 1, wherein the axial hole in the intermediate boom segment is a stepped through hole, and the elastic compression member and the adjusting bar are both arranged in the larger hole part of the stepped through hole.

10. The microphone boom structure according to claim 1, wherein the elastic compression member is a spring.

11. The microphone boom structure according to claim 2, wherein connecting lugs are separately provided at the ends of the first end boom segment and the second end boom segment that are closer to the intermediate boom segment, and both ends of the intermediate boom segments, respectively;

the connecting lugs are disposed on opposite sides of the axial hole; and a hinge shaft is connected between two adjacent connecting lugs of the first end boom segment and the adjacent intermediate boom segment, between two adjacent connecting lugs of the second end boom segment and the adjacent intermediate boom segment, and between two adjacent connecting lugs of two adjacent intermediate boom segments, respectively.

12. The microphone boom structure according to claim 11, wherein the hinge shaft is a cylindrical pin whose diameter is less than a diameter of a through hole in one of the connecting lugs and greater than a diameter of a through hole in the other connecting lug.

13. The microphone boom structure according to claim 12, wherein a diameter of a through hole located in the connecting lug at an outer side is less than a diameter of a through hole located in the connecting lug at an inner side.

14. The microphone boom structure according to claim 11, wherein the hinge shaft is a T-shaped pin whose diameter is less than a diameter of a through hole in one of the connecting lugs and greater than a diameter of a through hole in the other connecting lug; and an accommodating cavity for accommodating a larger end of the pin is further provided between the connecting lug and an outer side of the boom segment.

15. The microphone boom structure according to claim 3, wherein connecting lugs are separately provided at the ends of the first end boom segment and the second end boom segment that are closer to the intermediate boom segment, and both ends of the intermediate boom segments, respectively;

the connecting lugs are disposed on opposite sides of the axial hole; and a hinge shaft is connected between two adjacent connecting lugs of the first end boom segment and the adjacent intermediate boom segment, between two adjacent connecting lugs of the second end boom segment and the adjacent intermediate boom segment, and between two adjacent connecting lugs of two adjacent intermediate boom segments, respectively.

16. The microphone boom structure according to claim 15, wherein the hinge shaft is a cylindrical pin whose diameter is less than a diameter of a through hole in one of the connecting lugs and greater than a diameter of a through hole in the other connecting lug; and a diameter of a through hole located in the connecting lug at an outer side is less than a diameter of a through hole located in the connecting lug at an inner side.

17. The microphone boom structure according to claim 15, wherein the hinge shaft is a T-shaped pin whose diameter is less than a diameter of a through hole in one of the connecting lugs and greater than a diameter of a through hole in the other connecting lug; and an accommodating cavity for accommodating a larger end of the pin is further provided between the connecting lug and an outer side of the boom segment.

18. The microphone boom structure according to claim 4, wherein connecting lugs are separately provided at the ends of the first end boom segment and the second end boom segment that are closer to the intermediate boom segment, and both ends of the intermediate boom segments, respectively;

the connecting lugs are disposed on opposite sides of the axial hole; and a hinge shaft is connected between two adjacent connecting lugs of the first end boom segment and the adjacent intermediate boom segment, between two adjacent connecting lugs of the second end boom segment and the adjacent intermediate boom segment, and between two adjacent connecting lugs of two adjacent intermediate boom segments, respectively.

19. The microphone boom structure according to claim 18, wherein the hinge shaft is a cylindrical pin whose diameter is less than a diameter of a through hole in one of the connecting lugs and greater than a diameter of a through hole in the other connecting lug; and a diameter of a through hole located in the connecting lug at an outer side is less than a diameter of a through hole located in the connecting lug at an inner side.

20. The microphone boom structure according to claim 18, wherein the hinge shaft is a T-shaped pin whose diameter is less than a diameter of a through hole in one of the connecting lugs and greater than a diameter of a through hole in the other connecting lug; and an accommodating cavity for accommodating a larger end of the pin is further provided between the connecting lug and an outer side of the boom segment.

* * * * *